US006163021A

United States Patent [19]

Mickelson

[11] Patent Number: 6,163,021

[45] Date of Patent: Dec. 19, 2000

[54] NAVIGATION SYSTEM FOR SPINNING PROJECTILES

[75] Inventor: Wilmer A. Mickelson, Cedar Rapids, Iowa

[73] Assignee: Rockwell Collins, Inc., Cedar Rapids, Iowa

[21] Appl. No.: 09/211,534

[22] Filed: Dec. 15, 1998

[51] Int. Cl.[7] ..... F41G 7/00; F42B 15/01

[52] U.S. Cl. ..... 244/3.2; 244/3.1; 244/3.23; 244/164; 244/166; 701/220; 342/357.01; 342/357.06; 342/357.11

[58] Field of Search ..... 244/3.1, 3.15, 244/3.2–3.23, 158 R, 164, 165, 166, 171; 701/220; 342/357.01–357.17

[56] References Cited

U.S. PATENT DOCUMENTS

| | | | |
|---|---|---|---|
| 3,765,621 | 10/1973 | Shigehara | 244/166 |
| 3,834,653 | 9/1974 | Perkel | 244/166 |
| 4,062,509 | 12/1977 | Muhlfelder et al. | 244/166 |
| 4,347,996 | 9/1982 | Grosso | 244/3.16 |
| 4,444,053 | 4/1984 | Rider . | |
| 4,462,254 | 7/1984 | Rider . | |
| 4,520,669 | 6/1985 | Rider . | |
| 4,646,990 | 3/1987 | Cleveland, Jr. | 244/3.21 |
| 4,831,544 | 5/1989 | Hojo et al. | 701/220 |
| 5,114,094 | 5/1992 | Harris | 244/3.22 |
| 5,442,560 | 8/1995 | Kau . | |
| 5,497,704 | 3/1996 | Kurschner et al. . | |
| 5,740,986 | 4/1998 | Seidensticker et al. | 244/3.15 |
| 5,809,457 | 9/1998 | Yee et al. . | |

*Primary Examiner*—Bernarr E. Gregory
*Attorney, Agent, or Firm*—Nathan O. Jensen; Kyle Eppele; J. P. O'Shaughnessy

[57] ABSTRACT

A navigation system for spinning projectiles using a magnetic spin sensor to measure the projectile roll angle by sensing changes in magnetic flux as the projectile rotates through the earth's magnetic field is disclosed. The magnetic spin sensor measurements are used to despin a body reference frame such that position, velocity, and attitude of the projectile can be determined by using a strapdown inertial navigation system (INS) algorithm. More particularly, a multisensor concept is used to measure pitch and yaw angular rates, by measuring Coriolis acceleration along the roll axis and demodulating the pitch and yaw rates therefrom.

22 Claims, 3 Drawing Sheets

NAVIGATION SYSTEM FOR SPINNING PROJECTILES

FIELD OF THE INVENTION

The present invention is generally directed to inertial navigation systems. More specifically this invention relates to an inertial navigation system including a magnetic spin sensor, a Coriolis sensing accelerometer to measure angular rate, a linear accelerometer, and a global positioning system (GPS) receiver, mounted to a spinning projectile.

BACKGROUND OF THE INVENTION

A reference system having inertial instruments rigidly fixed along a vehicle-based orientation such that the instruments are subjected to vehicle rotations and the instrument outputs are stabilized computationally instead of mechanically is termed a gimballess or strapdown system. Such systems generally include computing means, receiving navigational data such as magnetic and radio heading; air data such as barometric pressure, density, and air speed; and output signals of the inertial instruments for generating signals representative of vehicle position and orientation relative to a system of known coordinate axes, usually earth oriented. The presence of high angular rates associated with strapdown systems adversely effects performance and mechanization requirements. Consequently, such reference systems have been used extensively in missiles, space, and military vehicles, but their use in commercial aircraft has been less extensive because of economic constraints associated with the manufacture of precision mechanical assemblies, i.e., gyroscopes and other precision sensors.

Ballistic trajectories and projectile epicyclical motion result in angular rates and linear accelerations having frequency spectra from 0 Hz to approximately 10 Hz. When these signals are sensed by a strapdown inertial sensor in a spinning projectile, the sensed signal (rate or acceleration) is modulated by the spin frequency ($F_S$). This results in the sensed signals having a frequency spectrum in the range of ($F_S$−10) Hz to ($F_S$+10) Hz. Multisensors have been used to separate rate and acceleration components by which one multisensor effectively measures two axes of angular rate and two axes of linear acceleration normal to the spin axis. Transducers in the form of multisensors such as these have been developed and used in aircraft and missile applications, being mounted on a spinning synchronous motor. Multisensors such as this have been described in U.S. Pat. No. 4,520,669 issued to Rider on Jun. 4, 1985 and assigned to Rockwell International Corp., the disclosure of which is incorporated herein by reference.

Standard strapdown inertial measuring technology applied to spinning projectiles (projectiles that spin at 100–350 revolutions per second) is impractical with available component technology. The primary limiting factors are as follows (1) available rate gyros (measuring angular rates such as roll, pitch, or yaw) cannot measure the high angular rates associated with a projectile spinning at 100–350 revolutions per second, (2) gyro scale factor errors may result in unacceptably large rate errors even when the high spin speeds can be measured, and (3) high centrifugal acceleration, in combination with mechanical misalignments, prevents accurate measurement of spin axis acceleration. Further, strapdown algorithms cannot be iterated at a high enough rate to accurately track the high spin speed.

Therefore, there is a need and desire for an artillery shell tracking system using a roll rate sensor, not limited by the high roll rates associated with spin stabilized projectiles. Further, there is a need and desire for a shell mounted low cost navigation system. Further still, there is a need and desire for an INS having improved accuracy by applying GPS measurements to provide error correction to INS attitude uncertainties. Further still, there is a need and desire for an INS having magnetic sensors to measure roll speed to despin a body axis frame measurements to a zero roll rate despun axis frame.

There is also a need and desire for a cost effective method of providing attitude, velocity, and position of a spinning projectile by utilizing a combination of inertial, magnetic and GPS measurements.

SUMMARY OF THE INVENTION

The present invention relates to a sensor system for a spinning object in a magnetic field that provides navigation information relative to a known frame of reference, the known frame of reference is defined by a first known axis. A second known axis is perpendicular to the first known axis, and a third known axis is perpendicular to the first and second known axes. The spinning object has a despun frame of reference defined by a first despun axis that is aligned with the spin axis of the projectile. A second despun axis is perpendicular to the first despun axis and the magnetic field, and a third despun axis is perpendicular to the first despun axis and the second despun axis. The navigation system includes a signal processor, at least one magnetic sensor and at least one angular rate sensor. The at least one magnetic sensor is adapted to provide a first electrical signal, to the signal processor, representative of the angular orientation of the body relative to the second despun axis and the third despun axis. The at least one angular rate sensor is adapted to provide a second electrical signal, to the signal processor, representative of the angular rate of rotation of the object relative to the known frame of reference. The signal processor processes the first and second electrical signals to provide output signals representative of the instantaneous attitude of the spinning object relative to the known frame of reference.

The present invention further relates to a navigation system for a spinning object in a magnetic field. The navigation system includes a signal processor, at least one magnetic sensor, a Coriolis acceleration sensor, at least one linear accelerometer, and a global positioning system receiver. The at least one magnetic sensor is attached to the spinning object and is adapted to provide a roll signal to the signal processor representative of the orientation of the magnetic sensor relative to the magnetic field. The Coriolis acceleration sensor is attached to the spinning object and is adapted to provide an attitude rate signal to the signal processor representative of the pitch rate and yaw rate of the object. The at least one linear accelerometer is attached to the spinning object and is adapted to provide an acceleration signal to the microprocessor representative of the components of acceleration of the spinning object perpendicular to the roll axis. The global positioning system receiver is attached to the spinning object and is adapted to provide a position signal to the signal processor representative of the position of the spinning object. The signal processor is adapted to provide an output signal representative of the position, velocity, and attitude of the spinning object.

The present invention still further relates to a method of determining the position, velocity, and attitude of a spinning projectile travelling through the magnetic field of the Earth. The method includes sensing the roll angle of the spinning projectile using a magnetic sensor, communicating the roll angle to an inertial navigation system, sensing the pitch rate and yaw rate of the spinning projectile using a Coriolis accelerometer, communicating the pitch rate and yaw rate to the inertial navigation system, sensing the acceleration of the spinning object, and communicating the acceleration of the spinning object to the inertial navigation system.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
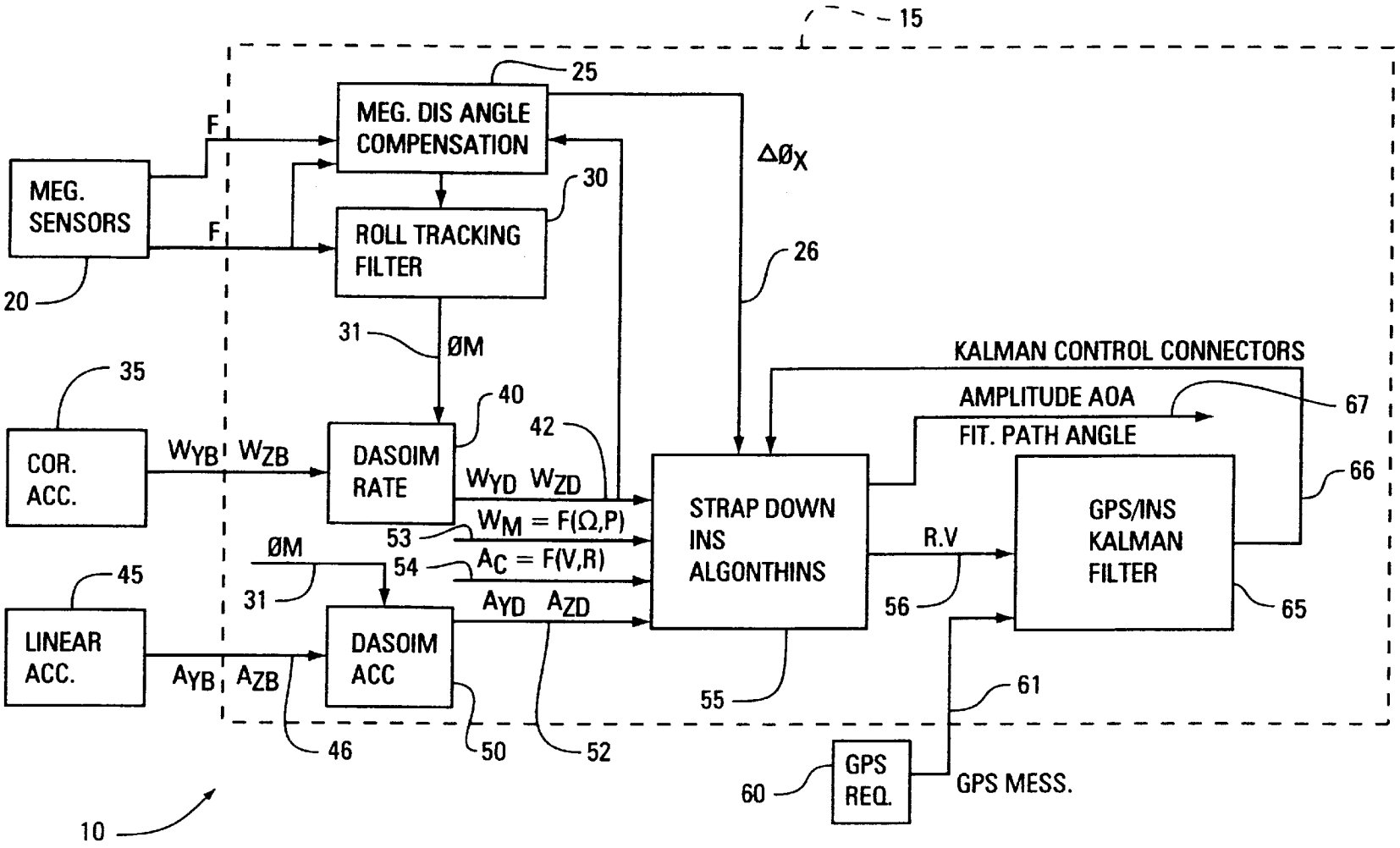
FIG. 1 is a schematic block diagram of a navigation system for a spinning projectile.

Referring to FIG. 1, a block diagram for a navigation system 10 is depicted. Navigation system 10 is a sensor system that includes magnetic sensors 20, magnetic dip angle compensation system 25, a roll tracking filter 30, a Coriolis accelerometer 35 to measure angular rates perpendicular to the spin axis, a despin rate system 40, a linear accelerometer 45, a despin acceleration system 50, a strapdown INS algorithm system 55, a GPS receiver 60, and a Kalman filter 65.

Figure 2:
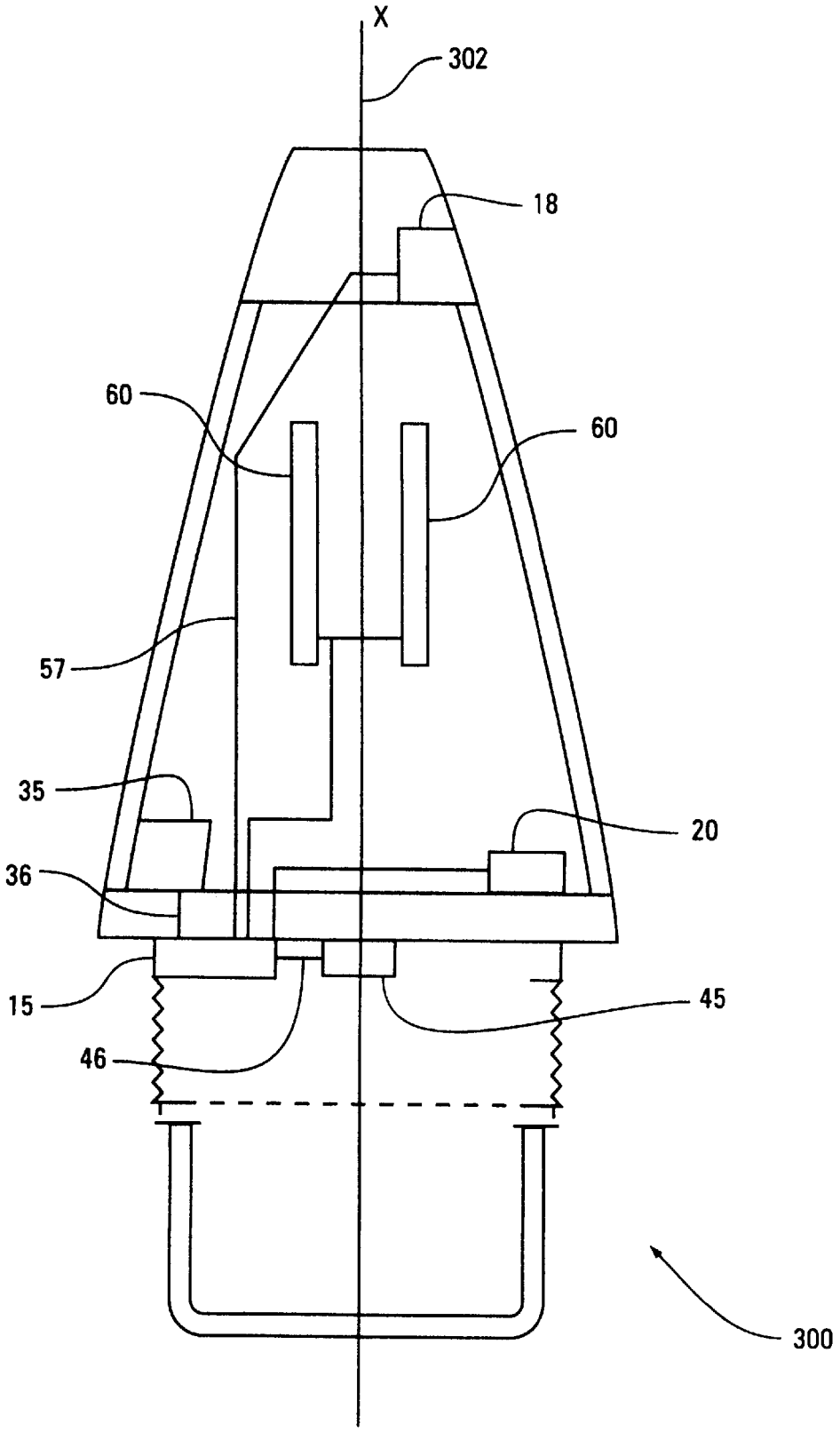
FIG. 2 is a schematic diagram of a spinning projectile having an on-board sensor and navigation system.

As depicted in FIG. 1 and FIG. 2, navigation system 10 is configured as sensors 20, 35, and 45, a receiver 60 and a signal processing system 15. System 15 can be configured as software running on a microprocessor or a signal processor based system having memory and analog to digital converters. Further, signal processing system 15 may have output signals on a data link provided on communication line 57 to a transmission antenna 18 as depicted in FIG. 2. Transmission antenna 18 may transmit radio frequency (RF) signals, or other electromagnetic signals, to a ground-based, air-based, naval-based, or space-based receiver.

Figure 3:
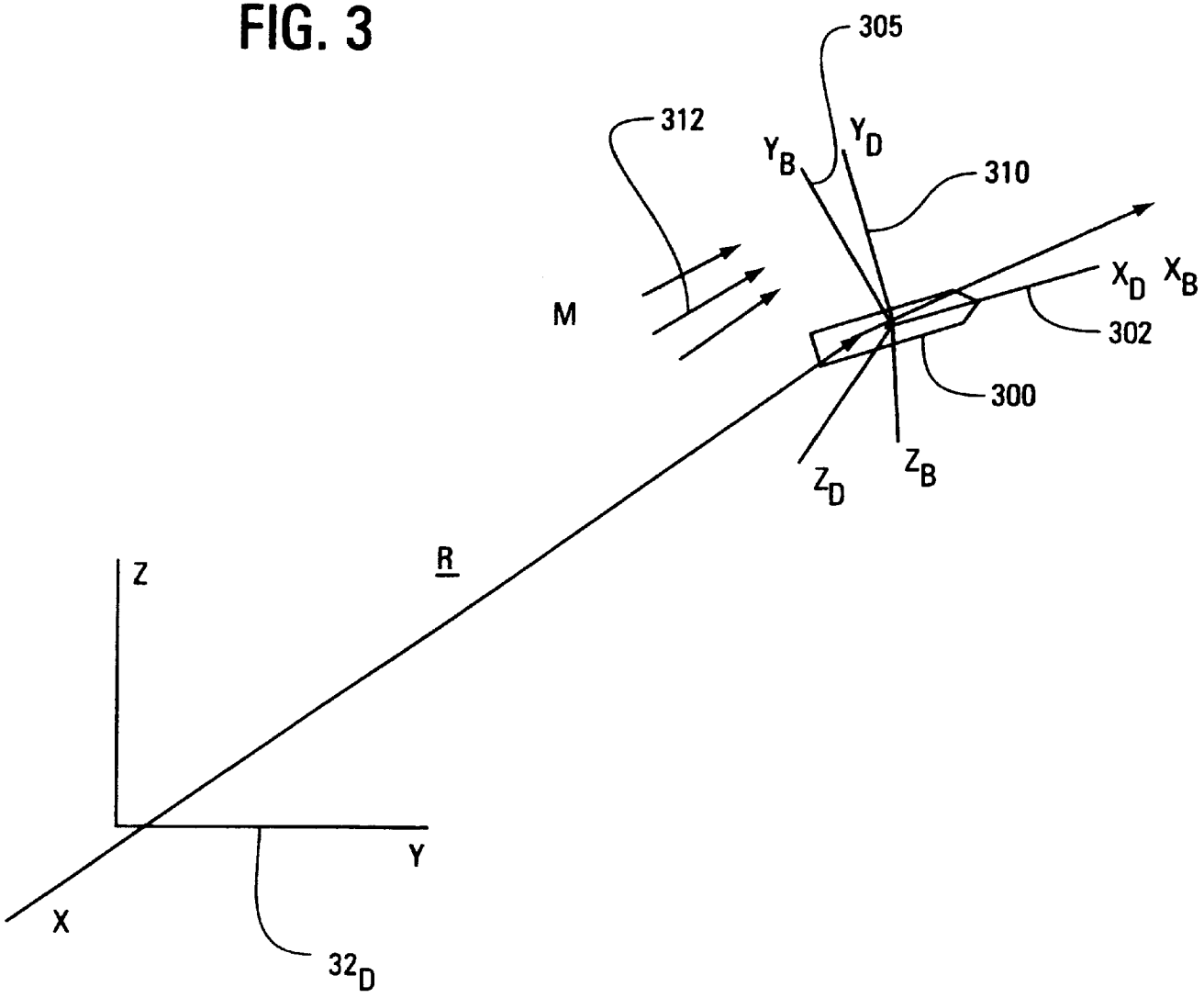
FIG. 3 is a schematic diagram showing coordinate reference frames.

Referring now to FIG. 3, a known frame of reference 320 is shown as perpendicular axis system (X, Y, Z). The spinning projectile has a body fixed frame of reference 305 with one axis along the spin axis ($x_B$), a second axis ($y_B$) perpendicular to the spin axis, and a third axis ($z_B=x_B\times y_B$). A third reference frame is defined as a despun reference frame 310 where a roll axis ($x_D$) is coincident with roll axis ($x_B$). Axis ($z_D$) is defined perpendicular to roll axis ($x_D$) and a magnetic flux vector M such that ($z_D=x_D\times M$). Axis ($y_D$) is defined as being perpendicular to ($z_D$) and ($x_D$) such that ($y_D=z_D\times x_D$). Despun reference frame 310 provides a convenient frame in which to relate inertially sensed measurements of linear acceleration and angular rate to a strapdown INS computational algorithm.

Magnetic spin sensor 20 is used to measure the projectile roll angle. As depicted in FIG. 3, the roll angle of a spinning projectile 300 is the angle of rotation of projectile 300 about a longitudinal axis 302 or, as depicted, the $x_D$-axis. Referring again to FIG. 1 magnetic sensors 20 sense the earth's magnetic field and the number of turns of the projectile are counted during flight.

When the earth's magnetic field is perpendicular to the spin axis, sensors 20 produce a sinusoidal voltage due to magnetic flux alternating in a direction through the coil of the magnetic sensors. As the alignment angle between the spin axis and the earth's magnetic field vector direction changes, the sine wave voltage amplitude decreases with the cosine of the alignment angle. There will always be a component of magnetic flux that alternates in a direction through the sensor coil producing a sine wave voltage regardless of the projectile angle, except in the singular case that the projectile spin axis is aligned with the lines of magnetic flux. One skilled in the art will recognize that numerous magnetic sensor designs may be applied as magnetic sensors 20. Further, it will also be appreciated, by one skilled in the art, that the alignment angle between the spin axis and the earth's magnetic field inclination can be compensated for by a magnetic dip angle compensation unit 25.

Typically, when using magnetic sensors 20, one complete sine wave represents one turn of the projectile if the spin axis remains fixed. A voltage is generated by magnetic sensor 20 sensing the time-varying magnetic field of the earth caused by the projectile spin. Using a conventional magnetic sensor, the sine wave generated from the sensor would show the voltage amplitude increasing until a peak point, at a quarter turn of the projectile, and then decreasing to zero, at the half turn point. The voltage reverses polarity and the amplitude increases, to the three quarters turn point, and then decreases to zero, when one complete turn has been made. Thus, by examining the sine wave generated over a period of time, the zero crossings can be counted, by roll tracking filter 30. (When one magnetic sensor 20 is used, each turn of the projectile produces two zero crossings.) One skilled in the art will recognize that well known signal processing techniques may be used to provide identification of and counting of zero crossings or the counting of periodic signals in transforming them to turns of the projectile. Further, one skilled in the art will recognize that it may be advantageous to use more than one magnetic sensor on the projectile, to provide better accuracy and robustness.

If the spin axis is not fixed as assumed above, (i.e., pitch rate and yaw rate are not zero) the zero crossings of the flux detector will not occur at exactly 180° roll increments. It can be shown that the correction to the 180° rotation is $\Delta\phi_x=(\Delta\phi_z)(M_x/M_z)$ where $\Delta\phi_z$ is the projectiles rotation in the pitch-yaw plane between successive magnetic zero crossings, $M_x$ is the magnetic flux along the spin axis and $M_z$ is the magnetic flux in the $y_B$, $z_B$ plane. This correction term is determined by the magnetic dip angle compensator 25 and used by both roll angle tracking filter 30 and strapdown INS algorithm 55 communicated along line 26. The determination of $M_x$ can be from either a separate roll axis magnetic flux sensor or from values computed based upon attitude and magnetic data provided during initialization.

Referring to FIG. 2, a schematic representation of a spinning projectile 300 is depicted. Magnetic sensors 20 may be positioned or mounted anywhere on or within the projectile body. Referring again to FIG. 1, magnetic sensors 20 communicate a sensor signal to magnetic dip angle compensator 25. Magnetic dip angle compensator 25 determines the correction ($\Delta\phi_x$) such that the actual roll angle displacement between zero crossings (approximately 180°) is known. The compensated roll angle is used to determine the spin rate of the object. A roll tracking filter 30 receives signals from magnetic sensors 20 and from magnetic dip angle compensator 25 to keep track of the roll angle of the projectile, roll tracking filter 30 generates an approximate reference angle $\hat{\phi}_M$. Therefore, roll tracking filter 30 communicates an approximate reference angle, $\hat{\phi}_M$ to despin rate subsystem 40 along a communication line 31.

Coriolis acceleration, along roll axis 302 ($x_D$), can be sensed by Coriolis accelerometer 35 and demodulated to determine the pitch and yaw angular rates of the projectile. Coriolis accelerometer 35 communicates a signal along line 36, representative of the pitch and yaw angular rates of the projectile, to despin rate subsystem 40. As depicted in FIG. 2, Coriolis accelerometer 35 is positioned radially away from axis 302 to sense Coriolis acceleration along the spin axis, the Coriolis acceleration being proportional to the distance from axis 302, proportional to the spin rate of the projectile and proportional to the pitch and yaw angular rates.

Coriolis accelerometer 35 may be any transducer capable of sensing acceleration which may be rapidly time-varying. Coriolis accelerometer 35 may be an AC transducer such as a piezoelectric transducer capable of sensing time-varying accelerations having frequencies greater than 10 Hz.

The approximate reference angle, $\hat{\phi}_M$ is used to transform the angular rate and the linear acceleration measurements to a despun axis system ($x_D$,$y_D$, $z_D$) 310, as depicted in FIG. 3.

Despin rate subsystem 40 receives angular rate signals from Coriolis accelerometer 35 along communication line 36 and receives a signal representative of the roll angle, i.e., roll angle approximation $\hat{\phi}_M$, along communication line 31. Despin rate subsystem 40 converts the sensed body axes rates to the despun coordinate frame 310 and communicates despun rates 42 to strapdown INS algorithm subsystem 55 and also supplies the despun angular rates to magnetic dip angle compensator 25.

Similarly, despin acceleration subsystem 50 receives an acceleration signal along communication line 46 from linear accelerometer 45 (see also FIG. 2) and also a roll angle approximation $\hat{\phi}_M$, along communication line 31. Linear accelerometer 45 is preferably an AC transducer capable of sensing time-varying accelerations in a frequency range of about 10 to 400 Hz. Despin acceleration subsystem 50 converts accelerations sensed in body axes 305 to despun coordinate frame 310. Despin acceleration subsystem 50 then communicates accelerations converted to despun axes 310 to strapdown INS algorithm 55 along communication line 52. Strapdown INS algorithm subsystem 55 also receives an angular velocity signal 53. Angular velocity signal 53 is an angular velocity of rotating known frame 320, signal 53 being a function of the earth's rotation rate ($\Omega$) and transport rate ($\rho$) computed from velocity. Strapdown INS algorithm subsystem 55 also receives an aerodynamic acceleration signal 54. Aerodynamic acceleration signal 54 is a modeled aerodynamic acceleration, the model is a function of the velocity of projectile 300 and the height above the earth's surface of projectile 300 as well as the physical geometries of projectile 300. The aerodynamic model may be a mathematical model, an empirical model based on wind tunnel data, a model based on a computational fluid dynamics (CFD) model, or the like. Further, in an alternative embodiment, strapdown INS algorithm subsystem 55 does not receive aerodynamic acceleration signal 54. In an alternative embodiment, a longitudinal accelerometer may be included in the sensor complement and interfaced to the signal processing system.

The despun measurements are processed by strapdown INS algorithm 55 as though the projectile is not spinning. Despun roll rate is computed from $\Delta\phi_x$, earth angular rate, and velocity. Despun roll acceleration is computed from a drag model using velocity and altitude or measured by a roll axis accelerometer.

Based on angular rate signal 42, earth angular rate signal 53, aerodynamic acceleration signal 54, and acceleration signal 52, strapdown INS algorithm 55 is able to generate an estimate of attitude, velocity, position, flight path angle, and angle of attack of projectile 300 relative to known reference frame 320 by producing a numerical or explicit solution to a system of differential equations relating to the motion of projectile 300. The position and velocity of projectile 300 are communicated along line 56 to a GPS/INS Kalman filter 65. Kalman filter 65 also receives a GPS signal from a GPS receiver 60 (see also FIG. 2) along line 61 providing a GPS position signal to Kalman filter 65.

The Kalman filter has long been used to estimate the position and velocity of moving objects from noisy measurements of, for example, range and bearing. Measurements of position and velocity may be made by equipment such as radar, sonar, optical equipment, or global positioning system equipment. Conventionally, Kalman filters are used to estimate the position and velocity of a moving object based on statistical characteristics of a noisy signal. Similarly, for spinning projectile 300 Kalman filter 65 is used to integrate the GPS data 61 and INS data 56. The filter estimates the errors in INS algorithm subsystem 55 solution and provides control corrections back to INS algorithm subsystem 55 to limit the error growth in attitude, velocity, and position. Kalman filter 65 estimates velocity errors, resulting from aerodynamic model 54, inertial frame angular velocity model 53 errors, due to roll reference angle $\hat{\phi}_M$ (which is a typically noisy signal), angular rate errors, and linear acceleration errors. One skilled in the art will readily appreciate that other filtering techniques may be used, such as, but not limited to extended Kalman filtering, Wiener filtering, Levinson filtering, neural network filtering, adaptive Kalman filtering, and other filtering techniques.

GPS/INS Kalman filter 65 processes signals communicated along lines 61 and 56 to output control corrections to strapdown INS algorithm subsystem 55 along communication line 66. Strapdown INS algorithm subsystem 55 uses these control corrections such that modeling errors and measurement errors are not cumulative and do not grow in magnitude with respect to time. Outputs of strapdown INS algorithm subsystem 55 may be supplied to an operator or an operation system along communication line 57. Communication line 57 may communicate the position, velocity, attitude, angle of attack, and flight path angle of projectile 300. The output communicated along line 57 may be used for navigation control of projectile 300 or for training purposes to track a state of projectile 300 during flight.

It is understood that, while the detailed drawings, specific examples, and particular component values given describe preferred embodiments of the present invention, they serve the purpose of illustration only. For example, the magnetic sensor system may be configured differently to supply an estimate of reference angle $\hat{\phi}_M$. Further, Kalman filter 65 may be substituted by a variety of other filtering algorithms. The apparatus of the invention is not limited to the precise details and conditions disclosed. Furthermore, other substitutions, modifications, changes, and omissions may be made in the design, operating conditions, and arrangement of the preferred embodiments without departing from the spirit of the invention as expressed in the appended claims.

What is claimed is:

1. A sensor system for a spinning object in a magnetic field, to provide navigation information relative to a known frame of reference, the known frame of reference defined by a first known axis, a second known axis being perpendicular to the first known axis, and a third known axis being perpendicular to the first and second known axes, the spinning object having a despun frame of reference defined by a first despun axis aligned with the spin axis of the projectile, a second despun axis perpendicular to the first despun axis and the magnetic field, and a third despun axis perpendicular to the first despun axis and the second despun axis, the navigation system comprising:

a signal processor;

at least one magnetic sensor in communication with the signal processor, the at least one magnetic sensor configured to provide a first electrical signal representative of the angular orientation of the body relative to the second despun axis and the third despun axis; and at least one angular rate sensor in communication with the signal processor, the at least one angular rate sensor configured to provide a second electrical signal representative of the angular rate of rotation of the object relative to the known frame of reference, wherein the signal processor processes the first and second electrical signals to provide output signals representative of the instantaneous attitude of the spinning object relative to the known frame of reference.

2. The sensor system of claim 1 further comprising at least one accelerometer in communication with the signal processor, the at least one accelerometer configured to provide a third electrical signal representative of the components of acceleration of the spinning object relative to the known frame of reference.

3. The sensor system of claim 2 wherein the signal processor further processes the third electrical signal to further provide output signals representative of the instantaneous position and velocity of the spinning object relative to the known frame of reference.

4. The sensor system of claim 2 further comprising a strapdown inertial navigation system configured to receive a fourth electrical signal representative of the angular rate of the projectile relative to the known frame of reference and a fifth electrical signal representative of the acceleration of the projectile relative to the known frame of reference, wherein the fourth electrical signal is transformationally related to the first and second electrical signals and the fifth electrical signal is transformationally related to the third electrical signal.

5. The sensor system of claim 4 further comprising a positioning unit in communication with the signal processor, the positioning unit configured to provide a sixth electrical signal representative of the position of the spinning object relative to the known frame of reference.

6. The sensor system of claim 5 wherein the positioning unit is a global positioning system (GPS) receiver.

7. The sensor system of claim 5 wherein the strapdown inertial navigation system provides a seventh electrical signal representative of the approximate position and velocity of the spinning object.

8. The sensor system of claim 7 further comprising an estimation filter receiving the sixth electrical signal and the seventh electrical signal and providing an error correction signal to the strapdown inertial navigation system.

9. The sensor system of claim 8 wherein the estimation filter is a Kalman filter.

10. The sensor system of claim 8 wherein the estimation filter is an extended Kalman filter.

11. The sensor system of claim 7 wherein the strapdown inertial navigation system provides an electrical output signal including signals representative of approximations of the instantaneous position, velocity, acceleration, attitude, angle of attack, and flight path angle of the spinning object.

12. A navigation system for a spinning object in a magnetic field comprising:

a signal processor;

at least one magnetic sensor, attached to the spinning object and in communication with the signal processor, the at least one magnetic sensor configured to provide a roll signal representative of the orientation of the magnetic sensor relative to the magnetic field;

a Coriolis acceleration sensor, attached to the spinning object and in communication with the signal processor, the Coriolis acceleration sensor configured to provide an attitude rate signal representative of the pitch rate and yaw rate of the object;

at least one linear accelerometer, attached to the spinning object and in communication with the signal processor, the at least one linear accelerometer configured to provide an acceleration signal representative of the components of acceleration of the spinning object perpendicular to the roll axis; and a global positioning system (GPS) receiver, attached to the spinning object and in communication with the signal processor, the GPS receiver configured to provide a position signal representative of the position of the spinning object, wherein the signal processor is adapted to provide an output signal representative of the position, velocity, and attitude of the spinning object.

13. The navigation system of claim 12 further comprising a strapdown inertial navigation system configured to receive inputs including a transformed attitude and roll signal and a transformed acceleration signal.

14. The navigation system of claim 13 wherein the strapdown inertial navigation system provides a position and a velocity signal representative of the approximate position and velocity of the spinning object.

15. The navigation system of claim 14 further comprising an estimation filter in communication with the strapdown inertial navigation system and configured to receive the position and the velocity signal and configured to provide an error correction signal to the strapdown inertial navigation system.

16. The navigation system of claim 15 wherein the estimation filter is a Kalman filter.

17. The navigation system of claim 16 wherein the strapdown inertial navigation system provides an output signal including signals representative of approximations of the instantaneous position, velocity, acceleration, attitude, angle of attack, and flight path angle of the spinning object.

18. A method of determining the position, velocity, and attitude of a spinning projectile travelling through the magnetic field of the Earth, the method comprising:

sensing the roll angle of the spinning projectile using a magnetic sensor;

communicating the roll angle to an inertial navigation system;

sensing the pitch rate and yaw rate of the spinning projectile using a Coriolis accelerometer;

communicating the pitch rate and yaw rate to the inertial navigation system;

sensing the acceleration of the spinning object; and communicating the acceleration of the spinning object to the inertial navigation system.

19. The method of claim 18 further comprising despinning the sensed angles, angular rates, and accelerations into despun signals.

20. The method of claim 19 further comprising transforming the despun signals into navigation signals.

21. The method of claim 20 further comprising filtering the position signals and the navigation signals to provide an error correction signal.

22. The method of claim 21 wherein the filtering step is carried out by a Kalman filter.

* * * * *